US009349261B1

(12) United States Patent
Salamone

(10) Patent No.: US 9,349,261 B1
(45) Date of Patent: May 24, 2016

(54) TABLE LIGHT

(71) Applicant: Robert Salamone, Whittier, CA (US)

(72) Inventor: Robert Salamone, Whittier, CA (US)

( * ) Notice: Subject to any disclaimer, the term of this patent is extended or adjusted under 35 U.S.C. 154(b) by 195 days.

(21) Appl. No.: 14/450,112

(22) Filed: Aug. 1, 2014

(51) Int. Cl.

| | |
|---|---|
| ***F21V 33/00*** | (2006.01) |
| ***G08B 5/36*** | (2006.01) |
| ***F21S 9/02*** | (2006.01) |
| *F21W 131/301* | (2006.01) |

(52) U.S. Cl.
CPC ... *G08B 5/36* (2013.01); *F21S 9/02* (2013.01); *F21V 33/0012* (2013.01); *F21V 33/0048* (2013.01); *F21W 2131/301* (2013.01)

(58) Field of Classification Search
None
See application file for complete search history.

(56) References Cited

U.S. PATENT DOCUMENTS 2,638,583 A * 5/1953 Edwards, Jr. ..... F21L 15/06 116/63 R
7,259,655 B1 * 8/2007 Potts ..... G08B 5/36 340/286.09eb
7,369,039 B1 * 5/2008 Knutson ..... G08B 5/36 340/286.09
2009/0078548 A1 * 3/2009 Singh ..... H01H 13/023 200/310

OTHER PUBLICATIONS

Amazon.com: iJDMTOY Blue LED Background Light Engine Ignition Push Start Button, retrieved Apr. 8, 2016.*

* cited by examiner

*Primary Examiner* — Britt D Hanley
(74) *Attorney, Agent, or Firm* — CIONCA Law Group P.C.; Marin Cionca

(57) ABSTRACT

A light device comprising a hollow, cylindrical and threaded bolt element, for housing at least a battery, and a head element, housing light elements and an actuating member of a switch, wherein the head element comprises a domed upper surface and an annular flat bottom surface, wherein, the domed upper surface comprises at least a transparent portion such that to allow light from the light elements to pass through when turned on, wherein the actuating member of a switch can be actuated by a user from the domed upper surface, wherein the exterior diameter of the head element is greater than the diameter of the hollow cylindrical bolt element, and wherein the head element comprises a threaded recess beginning at the inner edge of the annular flat bottom surface and extending towards the domed upper surface, for receiving the open end of the hollow cylindrical bolt element.

11 Claims, 3 Drawing Sheets

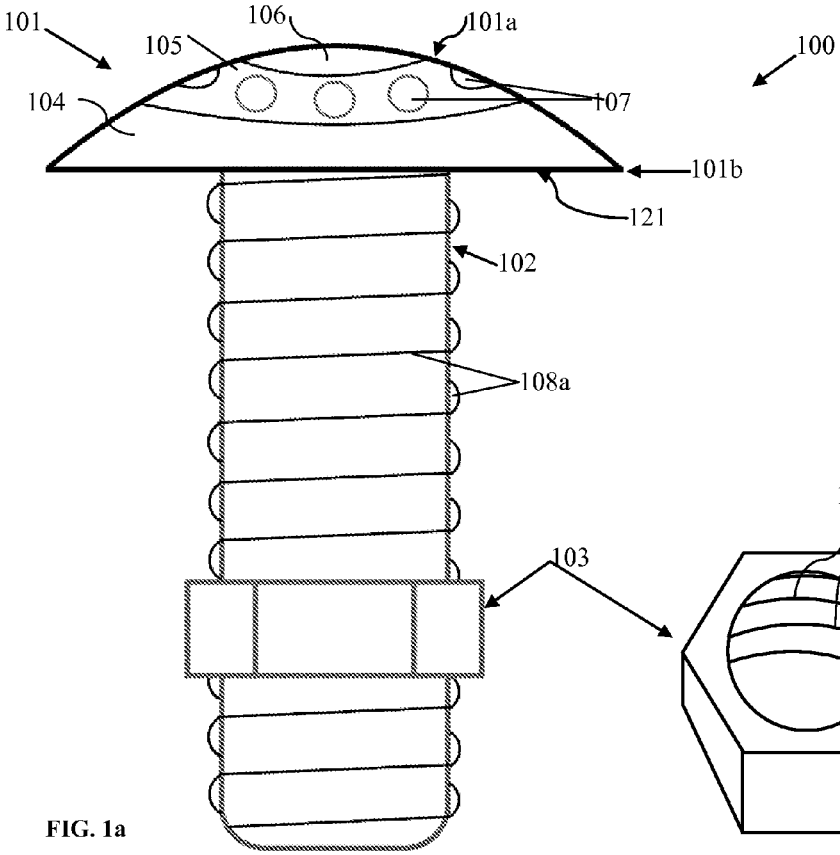
FIG. 1a
FIG. 1b
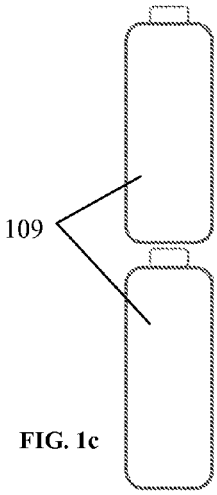
FIG. 1c
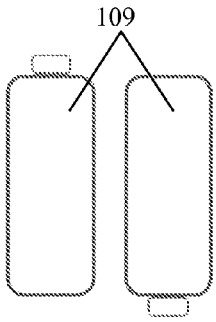
FIG. 1d

TABLE LIGHT

BACKGROUND OF THE INVENTION

1. Field of the Invention

The invention relates generally to light devices and more particularly to a light device installable into a table or desk.

2. Description of the Related Art

When needing assistance in a restaurant, a customer needs to try and get the attention of a server by waving his or her arm. This action by the customer is inconvenient and can be annoying to a customer if the server is not paying attention. Sometimes, a server will continue to go to a table and ask the customer if anything else is needed, interrupting a customer's conversation. This can be annoying as well.

Further, many times in a classroom, several students will have questions, raising their hands in the air, and waiting for the teacher to call on them. This can be disruptive and annoying to other students and annoying to the students raising their hands especially if they need to keep their hands raised for a long time.

Thus, there is a need for a device that can solve the problems described above and that can be used easily, conveniently and effectively.

BRIEF SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In one exemplary embodiment, a light device is provided that can be attached to each table in a restaurant, with the lens facing up, such that a customer could push the top of the lens down to turn on the light. As a server looks around the room, he or she would see the light is on and would thus know that the customer wants a server's attention. This is a more efficient solution to assist customers without the server being annoying, or the customer getting annoyed.

Further, by attaching this light device to each desk in a classroom with the light facing up, a student can turn the light on by pushing the lens down. Thus, when the light is on, the teacher will know that the student has a question.

The above embodiments and advantages, as well as other embodiments and advantages, will become apparent from the ensuing description and accompanying drawings.

BRIEF DESCRIPTION OF THE DRAWINGS

For exemplification purposes, and not for limitation purposes, embodiments of the invention are illustrated in the figures of the accompanying drawings, in which:

FIG. 1*a* illustrates a side view of a table light, according to an embodiment.

FIG. 1*b* illustrates a perspective view of the nut 103 from FIG. 1*a*.

FIGS. 1*c-d* illustrate samples of arrangement of batteries inside the table light from FIG. 1*a*.

DETAILED DESCRIPTION OF THE PREFERRED EMBODIMENTS

Figure 2A:
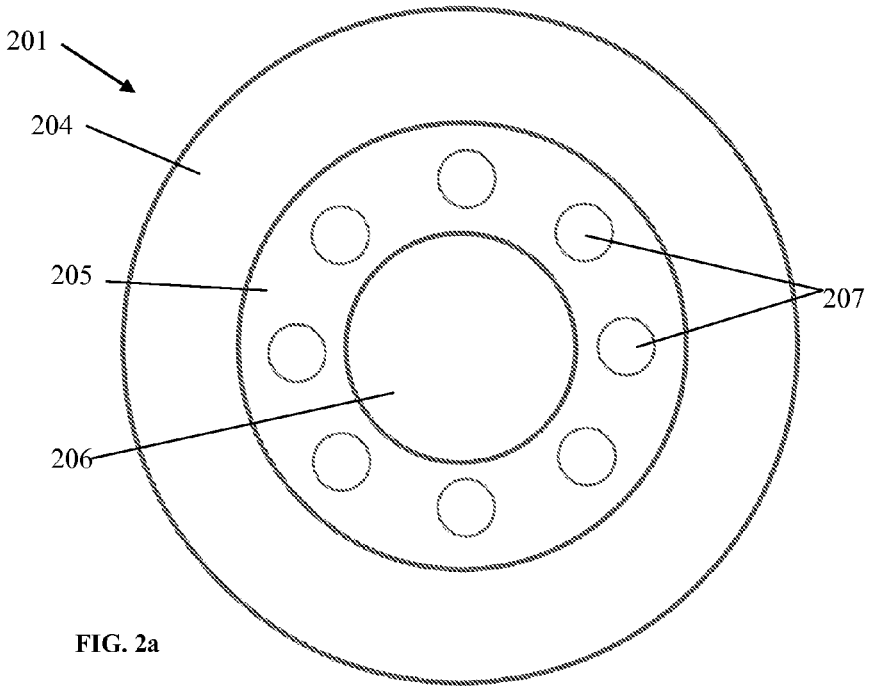
FIG. 2*a* illustrates the top view of the table light from FIG. 1*a*.

What follows is a detailed description of the preferred embodiments of the invention in which the invention may be practiced. Reference will be made to the attached drawings, and the information included in the drawings is part of this detailed description. The specific preferred embodiments of the invention, which will be described herein, are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

For the following description, it can be assumed that most correspondingly labeled structures across the figures (e.g., 101 and 201, etc.) possess the same characteristics and are subject to the same structure and function. If there is a difference between correspondingly labeled elements that is not pointed out, and this difference results in a non-corresponding structure or function of an element for a particular embodiment, then the conflicting description given for that particular embodiment shall govern.

FIG. 1*a* illustrates a side view of a table light, according to an embodiment. As shown, the table light 100 has three main sections or elements. They are the head element 101, the bolt element 102 and the nut element 103.

The head element 101, as shown, has preferably a domed upper surface 101*a*, and a flat bottom surface 121, joining together at an acute angle at the outer edge 101*b* of the head element 101. The completely domed upper surface 101*a* is preferred as it provides less interference with a person (e.g., student or patron) sitting a table having the table light 100 installed in it. The domed shape combined with a smooth finish may prevent inconvenience, scratches and/or cuts on a person's hands. Less interference is also provided by the acute shape (but not sharp as to cause cuts or scratches) of the outer edge 101*b*. The flat shape of the bottom surface 121 is preferred as it matches the flat top surfaces of most tables, desks, counters and the like, in which the table light 100 would typically be installed, as it will be described in more details hereinafter.

The head element 101 may be made for example from plastic or a combination of metal and plastic and is preferably substantially hollow, to accommodate the housing of the circuitry that is necessary for the function of the table light 100 as described herein.

As also shown in FIG. 1*a*, and more clearly in FIG. 2*a*, the head element's 101 (201 in FIG. 2*a*) top domed surface 101*a* may be divided in three distinct areas. They are the outer collar area 104 (204 in FIG. 2*a*), the light collar area 105 (205 in FIG. 2*a*) and the inner disk area 106 (206 in FIG. 2*a*). In this configuration, the outer collar area 104, is not typically a light source, other than, optionally, having a shiny finish (e.g., stainless steel) to reflect the light coming from the light collar area 105. Underneath the light collar area 105, a circular array of LED (Light Emitting Diode) lights 107 (207 in FIG. 2*a*) may be housed. It should be apparent that the light collar area 105 needs to be made from a transparent material (e.g., transparent/clear plastic or glass) to allow the light from the LEDs 107, when turned on, to pass through. In an alternative embodiment, the outer collar area 104 and the light collar area 105 can be merged, to create a larger light area.

The inner disk area 106 is preferably also the top surface of switch (not shown), which may be housed inside the head element 101 and/or the hollow bolt element, and which may be used to power the LEDs, by, for example, a user using a finger to press on the inner disk area 106. The switch may be spring loaded, to return the inner disk area 106 to the position shown in FIG. 1*a*, such as that the upper surface 101*a* of the head element 101 is maintained shaped as a dome. The inner disk area 106 may be marked (e.g., with the terms ON/OFF) to indicate the presence of a switch.

Figure 2B:
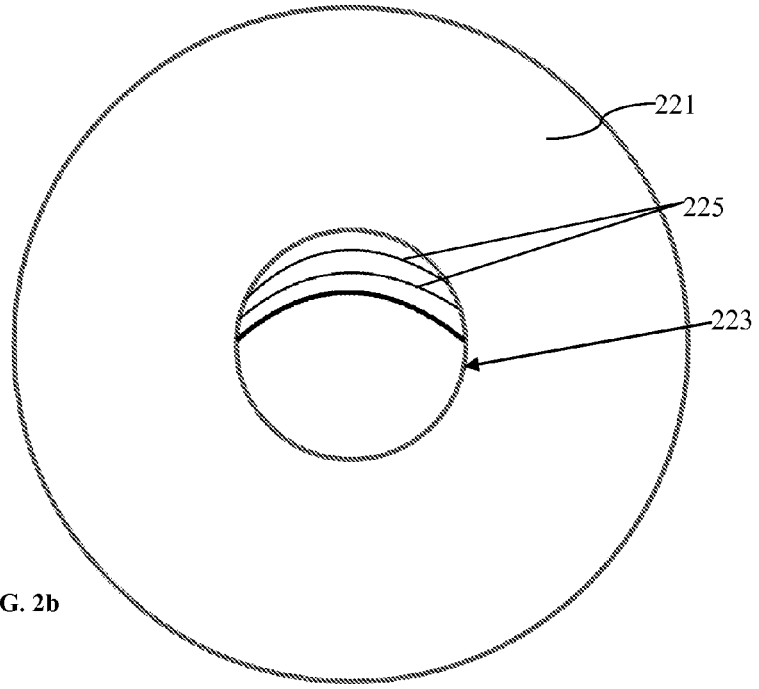
FIG. 2*b* illustrates the bottom view of the head element 101 of the table light from FIG. 1*a*.

FIG. 2*b* illustrates the bottom view of the head element 101 of the table light 100 from FIG. 1*a*. As shown, the flat bottom surface 221 has an annular shape. This is because, as shown, in the center of the bottom of the head element 101, there is a threaded recess 223. Its threads 225, correspond with threads 108*a* of the bolt element 102 (FIG. 1*a*), such as to permit removable attachment of the bolt element 102 to the head element 101, by screwing the upper end of the bolt element 102 into the recess 223 of the head element 101.

It should be understood that the flat bottom surface 221 may be that of a thin sheet of plastic for example, that may be removably attached to the upper domed portion of the head element 101, such as to permit access inside the head element, for, for example repair purposes.

Returning now to FIGS. 1*a-d*, as shown and as stated earlier the second and third element of the table light 100 are the bolt 102 and nut 103. The bolt element is hollow tube, closed at the lower end, threaded preferably on its entire length (see threads 108*a*) and open at the upper end such as to house and permit replacement of the batteries 109 (e.g., AA batteries). Thus, to insert the batteries 109 into the bolt 102, a user would simply have to unscrew the bolt 102 from the head element 101, place the batteries inside the hollow bolt, and screw the bolt back into the head element. The bolt element 102 may also house components and circuitry (e.g., switch components, connectors, etc) needed, as one of ordinary skills in the art would understand (i.e., similar to small LED flash light), to controllably (e.g., ON/OFF) supply power from the batteries 109 to the LEDs 107.

As shown in FIGS. 1*c-d*, inside the hollow bolt 102, the batteries 109 may be arranged in a linear configuration (FIG. 1*c*), or, a side-by-side configuration (FIG. 1*d*), such as when, although the diameter of the bolt 102 will be larger, a shorter length of the bolt is desired.

Figure 3:
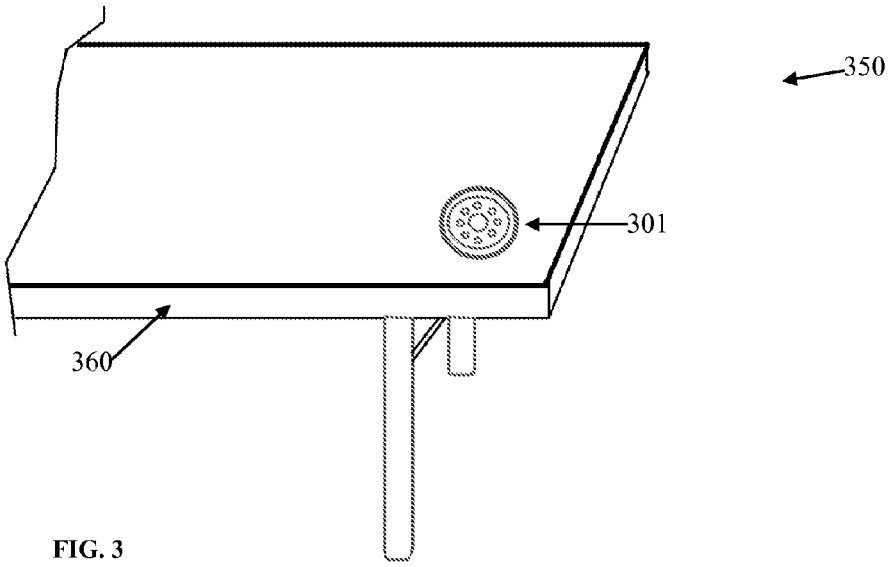
FIG. 3 illustrates a top perspective view of a portion of a table having installed in it the table light from FIG. 1*a*.

A nut 103, having nut threads 108*b* corresponding to bolt threads 108*a*, may be provided to secure the table light to a table as shown in FIG. 3, or any other similar object. Thus, to secure the table light into a table or desk 350, or any other object having a similar panel 360 (e.g., kitchen countertop, etc), a user would preferably drill a hole into the panel 360 having a diameter that permits the sliding of the bolt element 102 through the hole from the top, but not permitting the head element 101 to pass through the hole, and then, fastening the table light to the table by screwing the nut 103 onto the bolt 102 starting from its bottom end. As such, the bottom surface 121 of the head element 101 would rest onto the top surface of panel 360. Alternatively, the hole could be made slightly smaller than the diameter of bolt 102, such as to permit fastening by simply screwing the bolt into the hole, without using the nut 103.

Thus, for example, a patron or student sitting at table or desk 350 could simply press disk area 106 to cause the LED lights 107 to turn on and as such get the attention of the waitress or teacher, such as when they have a question to ask, instead of raising their hand.

Figure 4:
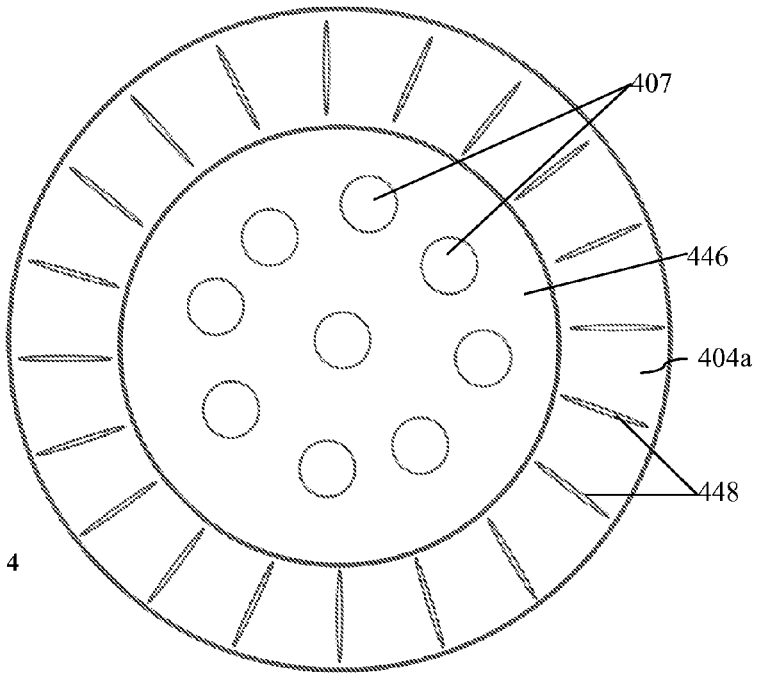
FIG. 4 illustrates the top view of an alternative embodiment of the table light from FIG. 1*a*.

FIG. 4 illustrates the top view of an alternative embodiment of the table light from FIG. 1*a*. In this embodiment, light area 105 and central disk area 106 (FIG. 1) are preferably merged into a greater light area 446 having a plurality of LEDs 407 associated with it. The switch function may be transferred to the outer collar 404*a*, which may be actuated by a similar 'press' action or a rotating action, in which case, grooves or ribs 448 may be provided for a better adherence to user's fingers.

Many alternative designs may be used, but what it is important here is that (1) the hollow bolt (cylinder) housing the batteries has to, preferably, have the outer threads for easy and secure fastening to a desk or table, as described earlier; (2) the switch can be actuated from the top (domed upper surface); and (3) that the exterior diameter of the outer collar is greater than the diameter of the hollow bolt so that the head element does not fall through the hole drilled into the desk or table.

Several other applications for the light device described herein may be envisioned. For example, the light device may be installed anywhere in a home (e.g., into kitchen or bathroom countertops), or any other buildings (e.g., office) and then used during power outage instead of candles or portable flash lights.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

As used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

Throughout this description, the embodiments and examples shown should be considered as exemplars, rather than limitations on the apparatus and procedures disclosed or claimed. Although many of the examples involve specific combinations of method acts or system elements, it should be understood that those acts and those elements may be combined in other ways to accomplish the same objectives.

Although specific embodiments have been illustrated and described herein for the purpose of disclosing the preferred embodiments, someone of ordinary skills in the art will easily detect alternate embodiments and/or equivalent variations, which may be capable of achieving the same results, and which may be substituted for the specific embodiments illustrated and described herein without departing from the scope of the invention. Therefore, the scope of this application is intended to cover alternate embodiments and/or equivalent variations of the specific embodiments illustrated and/or described herein. Hence, the scope of the invention is defined by the accompanying claims and their equivalents. Furthermore, each and every claim is incorporated as further disclosure into the specification and the claims are embodiment(s) of the invention.

What is claimed is:

1. A light device installable into a flat panel and comprising a hollow cylindrical bolt element, closed at one end and open at the opposite end, for housing at least a battery and having its substantially entire outer surface between the two ends threaded, and a head element, housing light elements and an actuating member of a switch, wherein the head element comprises a domed upper surface and an annular flat bottom surface, joining together at an acute angle at the outer edge of the head element, wherein, the domed upper surface comprises at least a transparent portion such that to allow light from the light elements to pass through when turned on, wherein the actuating member of a switch can be actuated by a user from the domed upper surface, wherein the exterior diameter of the head element is greater than the diameter of the hollow cylindrical bolt element, and wherein the head element comprises a threaded recess beginning at the inner edge of the annular flat bottom surface and extending towards the domed upper surface, for receiving the open end of the hollow cylindrical bolt element.

2. The light device of claim 1, further comprising a threaded nut, receivable by the closed end of the hollow cylindrical bolt element, for securing the light device to the flat panel after sliding the hollow cylindrical bolt element through a pass-through hole made in the flat panel.

3. The light device of claim 1, wherein the flat panel is the top flat panel of a table or a desk.

4. The light device of claim 1, wherein the domed upper surface comprises an outer collar area, a transparent light collar area underneath of which the light elements are housed, and an inner disk area from where the actuating member of the switch can be actuated by the user.

5. The light device of claim 1, wherein the domed upper surface comprises a central, circular and transparent light area underneath of which the light elements are housed, and an outer annular area from where the actuating member of the switch can be actuated by the user.

6. The light device of claim 1, wherein the light elements are light emitting diodes (LEDs).

7. A system comprising:

a furniture article comprising a flat horizontal panel having a top flat surface and a bottom flat surface, wherein the horizontal panel has a pass-through vertical hole in it, and a light device comprising a hollow cylindrical bolt element, closed at one end and open at the opposite end, for housing at least a battery and having its substantially entire outer surface between the two ends threaded, and a head element, housing light elements and an actuating member of a switch, wherein the head element comprises a domed upper surface and an annular flat bottom surface, joining together at an acute angle at the outer edge of the head element, wherein, the domed upper surface comprises at least a transparent portion such that to allow light from the light elements to pass through when turned on, wherein the actuating member of a switch can be actuated by a user from the domed upper surface, wherein the exterior diameter of the head element is greater than the diameter of the hollow cylindrical bolt element, wherein the head element comprises a threaded recess beginning at the inner edge of the annular flat bottom surface and extending towards the domed upper surface, for receiving the open end of the hollow cylindrical bolt element, and wherein the light device is installed into the flat horizontal panel by placing the hollow cylindrical bolt element into the pass-through vertical hole, such that the annular flat bottom surface of the head element rests on the top flat surface of the flat horizontal panel.

8. The system of claim 7, wherein the furniture article is a table or a desk.

9. A method of signaling a standing person present in a room by a user sitting at a table or a desk in that room, the table or desk comprising a flat horizontal panel having a top flat surface and a bottom flat surface, wherein the horizontal panel has a pass-through vertical hole in it, comprising actuating a light device, wherein the light device comprises a hollow cylindrical bolt element, closed at one end and open at the opposite end, for housing at least a battery and having its substantially entire outer surface between the two ends threaded, and a head element, housing light elements and an actuating member of a switch, wherein the head element comprises a domed upper surface and an annular flat bottom surface, joining together at an acute angle at the outer edge of the head element, wherein, the domed upper surface comprises at least a transparent portion such that to allow light from the light elements to pass through when turned on, wherein the actuating member of a switch can be actuated by the user from the domed upper surface, wherein the exterior diameter of the head element is greater than the diameter of the hollow cylindrical bolt element, wherein the head element comprises a threaded recess beginning at the inner edge of the annular flat bottom surface and extending towards the domed upper surface, for receiving the open end of the hollow cylindrical bolt element, and wherein the light device is installed into the flat horizontal panel by placing the hollow cylindrical bolt element into the pass-through vertical hole, such that the annular flat bottom surface of the head element rests on the top flat surface of the flat horizontal panel.

10. The method of claim 9, wherein the standing person is a restaurant server and the user is a patron.

11. The method of claim 9, wherein the standing person is a teacher and the user is a student.

* * * * *